US009713816B2

(12) United States Patent
Robert

(10) Patent No.: US 9,713,816 B2
(45) Date of Patent: Jul. 25, 2017

(54) ZERO WASTE COLOR CHANGE SYSTEM

(71) Applicant: Pierre-Alexandre Robert, Québec (CA)

(72) Inventor: Pierre-Alexandre Robert, Québec (CA)

(73) Assignee: PACCAR INC, Bellevue, WA (US)

( * ) Notice: Subject to any disclaimer, the term of this patent is extended or adjusted under 35 U.S.C. 154(b) by 31 days.

(21) Appl. No.: 14/662,694

(22) Filed: Mar. 19, 2015

(65) Prior Publication Data

US 2016/0271634 A1 Sep. 22, 2016

(51) Int. Cl.

| | |
|---|---|
| ***B67D 7/60*** | (2010.01) |
| ***B05B 9/047*** | (2006.01) |
| ***B05B 12/14*** | (2006.01) |
| *B05B 15/02* | (2006.01) |

(52) U.S. Cl.

CPC ..... *B05B 9/047* (2013.01); *B05B 12/149* (2013.01); *B05B 12/1463* (2013.01); *B05B 15/025* (2013.01)

(58) Field of Classification Search

CPC .... B05B 9/047; B05B 12/149; B05B 12/1463
USPC ..... 222/387; 92/183, 181 R
See application file for complete search history.

(56) References Cited

U.S. PATENT DOCUMENTS

| | | | | |
|---|---|---|---|---|
| 1,574,183 | A * | 2/1926 | Bodfish | B05B 9/047 137/564.5 |
| 3,403,695 | A | 10/1968 | Hopkins | |
| 4,269,355 | A | 5/1981 | Geberth, Jr. | |
| 5,228,919 | A | 7/1993 | Baker | |
| 5,249,709 | A | 10/1993 | Duckworth | |
| 5,310,091 | A | 5/1994 | Dunning | |
| 5,310,120 | A | 5/1994 | Ehinger et al. | |
| 5,411,211 | A | 5/1995 | Greene | |
| 6,164,561 | A | 12/2000 | Yoshida | |
| 6,179,217 | B1 | 1/2001 | Yoshida | |

(Continued)

FOREIGN PATENT DOCUMENTS

| | | |
|---|---|---|
| CA | 2 376 486 A1 | 11/2001 |
| EP | 0 880 998 A2 | 12/1998 |

(Continued)

OTHER PUBLICATIONS

"New York City Transit Authority (NYCTA)," Managed Air Systems LLC, Bloomfield, Conn., <http://managedairsystems.com/booth/paint-spray-boothin-ct-ny-ma-vt-nh-me-ri/york-city-transit-aurhority-nycta/> [retrieved Aug. 15, 2014], 4 pages.

(Continued)

*Primary Examiner* — Patrick M Buechner
*Assistant Examiner* — Jeremy W Carroll
(74) *Attorney, Agent, or Firm* — Christensen O'Connor Johnson; Matthew Balint; John Denkenberger

(57) ABSTRACT

A paint cartridge includes a housing and a piston slidably disposed within a cavity in the housing to divide the cavity into a paint chamber and a solvent chamber. A valve assembly extends through an aperture in the piston to selectively put the paint chamber in fluid communication with the solvent chamber. A solvent inlet provides solvent to the solvent chamber to move the piston. Movement of the piston discharges paint from the paint chamber through the paint outlet.

17 Claims, 9 Drawing Sheets

(56) References Cited

U.S. PATENT DOCUMENTS

| | | | | |
|---|---|---|---|---|
| 6,338,441 | B1 * | 1/2002 | Umezawa | B05B 3/1064 239/104 |
| 6,544,233 | B1 * | 4/2003 | Fukui | A61M 5/31596 604/191 |
| 6,612,345 | B1 | 9/2003 | Hosoda | |
| 6,666,164 | B2 | 12/2003 | Yoshida | |
| 6,705,361 | B2 | 3/2004 | Niederquell | |
| 7,588,196 | B2 | 9/2009 | Kubota | |
| 7,922,107 | B2 | 4/2011 | Fox | |
| 8,668,399 | B2 | 3/2014 | Parks | |
| 8,689,730 | B2 | 4/2014 | Clifford | |
| 8,992,505 | B2 * | 3/2015 | Thorne, Jr. | A61M 5/31596 604/122 |
| 9,126,817 | B2 | 9/2015 | Yamauchi | |
| 2002/0056722 | A1 | 5/2002 | Velde | |
| 2002/0158148 | A1 * | 10/2002 | Hosoda | B05B 3/1064 239/305 |
| 2006/0202067 | A1 | 9/2006 | Mitsui | |
| 2008/0185097 | A1 | 8/2008 | Walter | |
| 2010/0307413 | A1 | 12/2010 | Mitsui | |
| 2011/0192913 | A1 | 8/2011 | Matsumoto | |
| 2012/0175432 | A1 | 7/2012 | Milojevic | |
| 2012/0265171 | A1 * | 10/2012 | Thorne, Jr. | A61M 5/31596 604/518 |
| 2014/0060664 | A1 * | 3/2014 | Abbott | F04B 9/14 137/101.11 |

FOREIGN PATENT DOCUMENTS

| | | | |
|---|---|---|---|
| FR | 901 634 | A | 8/1945 |
| JP | 2008 168233 | A | 7/2008 |
| WO | 2008/007812 | A1 | 1/2008 |

OTHER PUBLICATIONS

Sekhri, A., et al., "Precision/Batch Metering Paint System," Nellis AFB, Nev., <http://infohouse.p2ric.org/ref/08/07292.htm> [retrieved Aug. 15, 2014], 5 pages.

Woo, D.-C., "Robotics in Highway Construction & Maintenance," Public Roads 59(2):1-7, Winter 1995.

International Search Report mailed Aug. 3, 2016, issued in corresponding International Application No. PCT/CA2016/000119, filed Apr. 1, 2016, 4 pages.

European Search Report mailed Aug. 23, 2016, issued in corresponding European Application No. 16160260.2, filed Mar. 15, 2016, 4 pages.

* cited by examiner

ZERO WASTE COLOR CHANGE SYSTEM

BACKGROUND

Current paint delivery systems capable of delivering multiple paint colors present a number of challenges with regard to waste and inefficiency during color changes. These systems are particularly inefficient in low volume applications. Even with improvements to existing systems, there can still be up to 40% wasted paint on non-recirculated paint supplies. In addition to wasted paint, large quantities of solvent are used to flush the pump for a color change. This is largely due to the distance between the paint supply and the applicator, which requires that the system be cleaned when changing paint colors. Thus, there is a need for a paint delivery system that allows for the delivery of multiple colors while minimizing wasted materials.

SUMMARY

In a first exemplary embodiment, a paint cartridge includes a housing and a piston slidably disposed within a cavity in the housing to divide the cavity into a paint chamber and a solvent chamber. A valve assembly extends through an aperture in the piston to selectively put the paint chamber in fluid communication with the solvent chamber. A solvent inlet provides solvent to the solvent chamber to move the piston. Movement of the piston discharges paint from the paint chamber through the paint outlet.

In a second exemplary embodiment, a paint cartridge has a housing with an internal cavity. A piston is slidably disposed within the internal cavity and divides the internal cavity into a paint chamber and a solvent chamber. A valve assembly selectively opens and closes fluid communication between the paint chamber and the solvent chamber. A solvent supply provides pressurized solvent to the solvent chamber to move the piston.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
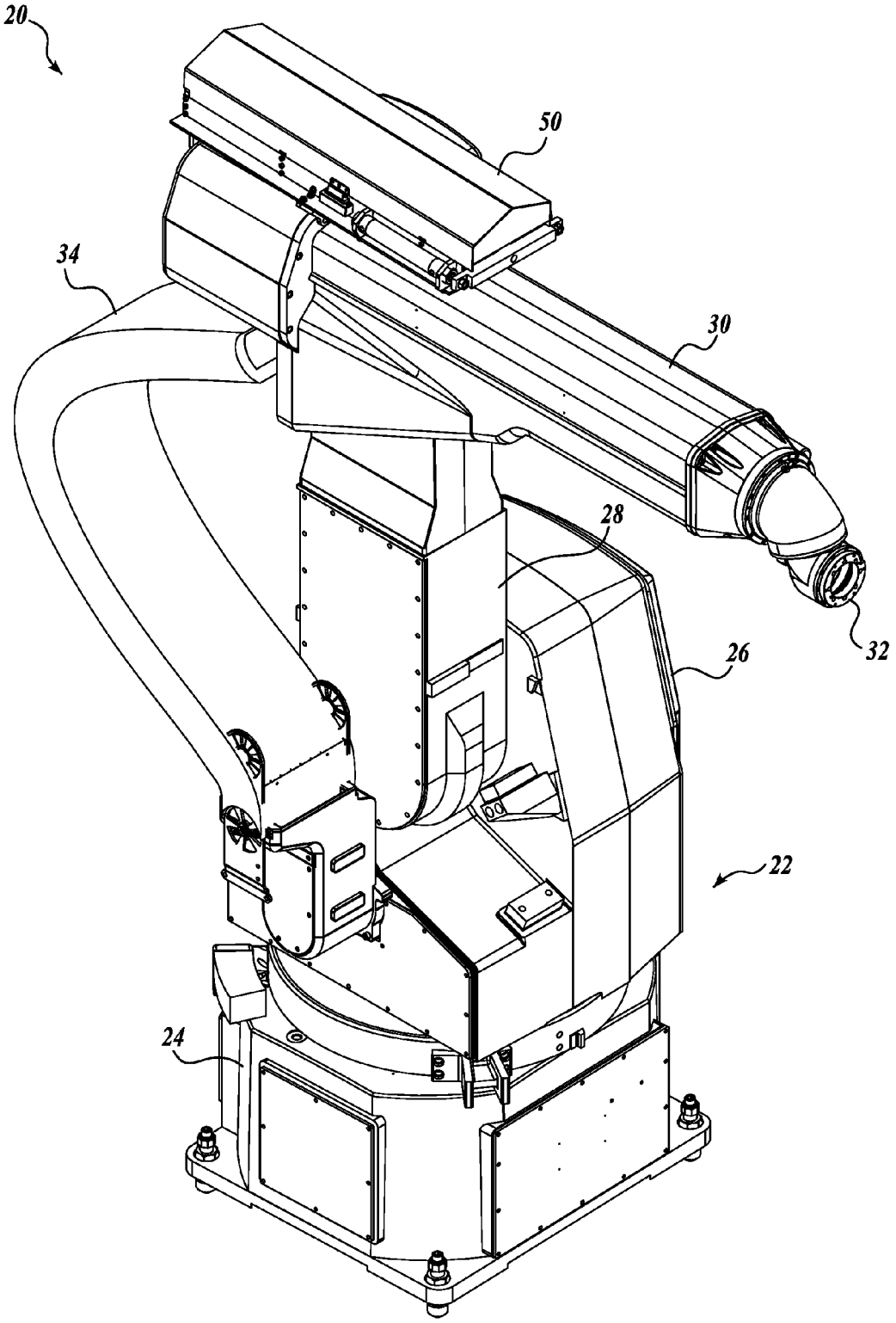
FIG. 1 shows an isometric view of an exemplary embodiment of a paint robot.

FIG. 1 shows an exemplary embodiment of a paint robot 20 suitable for use in an industrial setting. The robot 20 includes a base 22 having a lower portion 24 mounted to the floor or another suitable mounting surface. An upper portion 26 of the base 22 is rotatably mounted to the lower portion 24 about a vertical axis so that the upper and lower portions 24 and 26 cooperate to form a turntable structure. An arm 28 is rotatably coupled to the upper portion 24 of the base 22 at a first end about a horizontal axis.

A sprayer 30 is rotatably coupled to a second end of the arm 28 about a horizontal axis. A nozzle 32 is disposed at one end of the sprayer 30, and a docking station 50 is mounted to the top of the sprayer. As will be described in greater detail, docking station 50 is configured to receive a paint cartridge. When mounted to the docking station 50, the paint cartridge is in fluid connection with the nozzle 32 so that paint from the cartridge can be selectively discharged through the nozzle during operation. To utilize a different paint color or to replace a depleted paint cartridge, the paint cartridge 100 is removed from the docking station 50 and replaced with a cartridge having a different paint or a cartridge of the same color that is full of paint. A flexible conduit 34 extends from the base 22 to the nozzle 32 to house various electrical lines, pneumatic lines, solvent supply lines, etc., that control the position of the sprayer 30 and the discharge of paint from the nozzle 32.

It will be appreciated that the illustrated paint robot 20 is exemplary only and should not be considered limiting. In this regard, the presently disclosed paint system can be used with any number of suitable paint systems.

Figure 2:
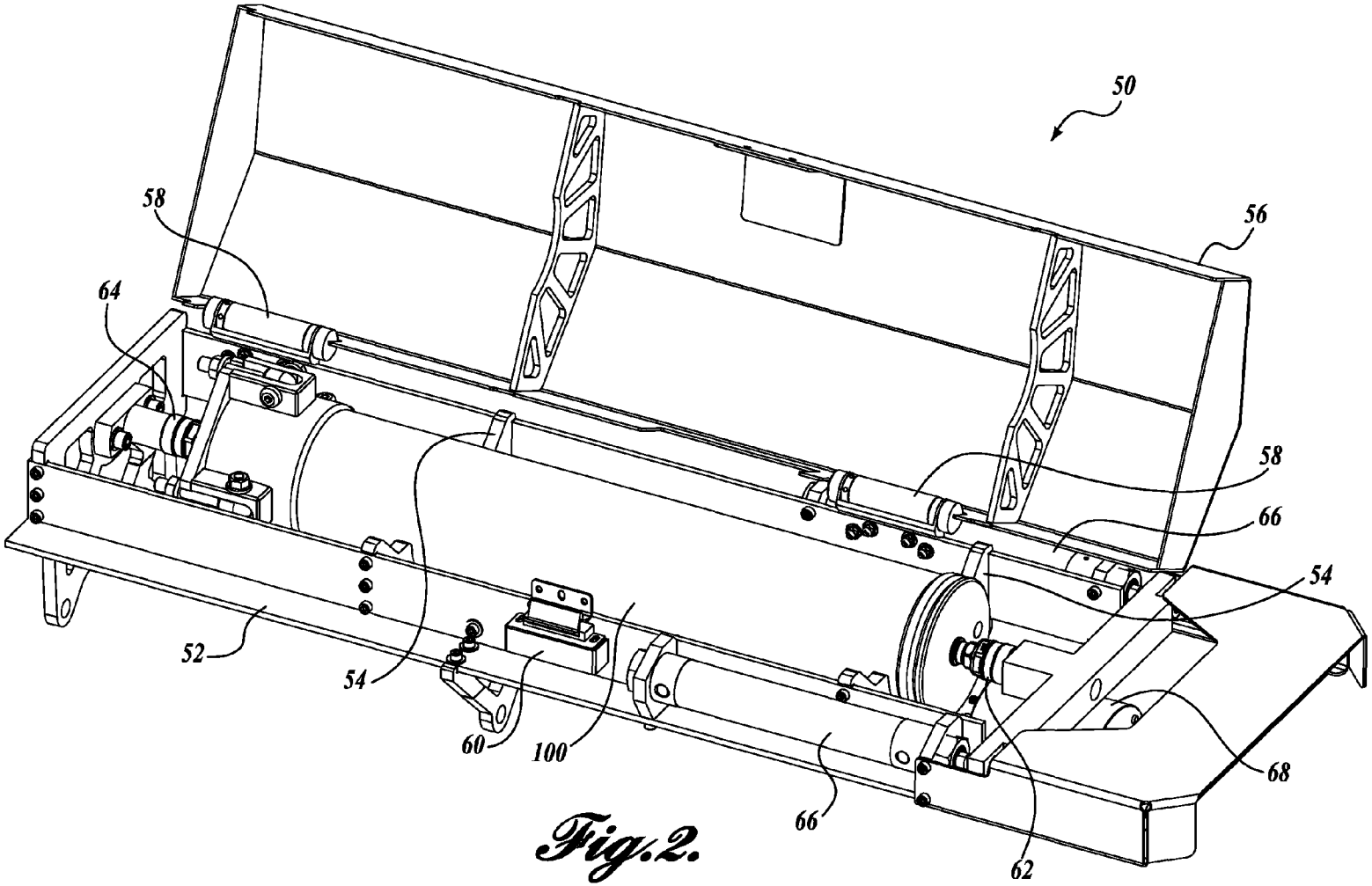
FIG. 2 shows an isometric view of a docking station of the paint robot of FIG. 1.
Figure 3:
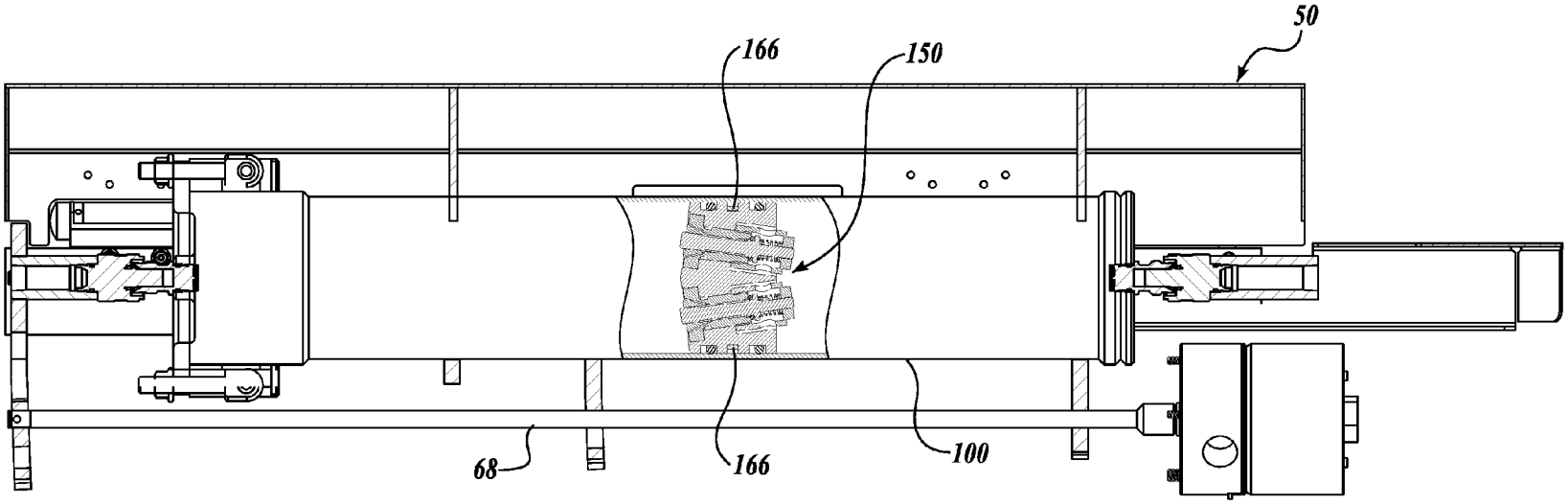
FIG. 3 shows a side cross-sectional view of the docking station of FIG. 2.

Referring now to FIGS. 2 and 3, the docking station 50 will be described. The docking station 50 includes a base 52 sized and configured to receive a cartridge 100 therein. The base 52 includes a plurality of support members 54 extending across the base to support the cartridge 100. A lid 56 is hingedly coupled to the base 52 by a plurality of hinges 58. In the illustrated embodiment, the hinges 58 are spring loaded to bias the lid 56 toward an open position. To close the docking station 50, the lid is rotated about the hinges 58 to a closed position and held in place with a latch 60.

Disposed at opposite ends of the docking station 50 are a supply fitting 62 and a discharge fitting 64. As will be discussed in further detail, the supply fitting 62 engages one end of the cartridge 100 to provide pressurized solvent to the cartridge, and the discharge fitting 64 engages an opposite end of the cartridge such that paint exits the cartridge through the discharge fitting. In the illustrated embodiment, the supply fitting 62 is coupled to a pair of pneumatic clamping cylinders 66. The clamping cylinders are secured to the base 52 of the docking station 50 and are positioned to selectively move the supply fitting 62 toward the discharge fitting 64, so that the supply fitting and discharge fitting engage the cartridge to releasably secure the cartridge within the docking station 50.

The docking station 50 further includes a sensor 68. In the illustrated embodiment, the sensor 68 extends longitudinally along the docking station 50 in proximity to the cartridge 100. As will be described in further detail, the sensor 68 senses information regarding the amount of paint in the cylinder to allow for the system to manage the paint supply.

Figure 4:
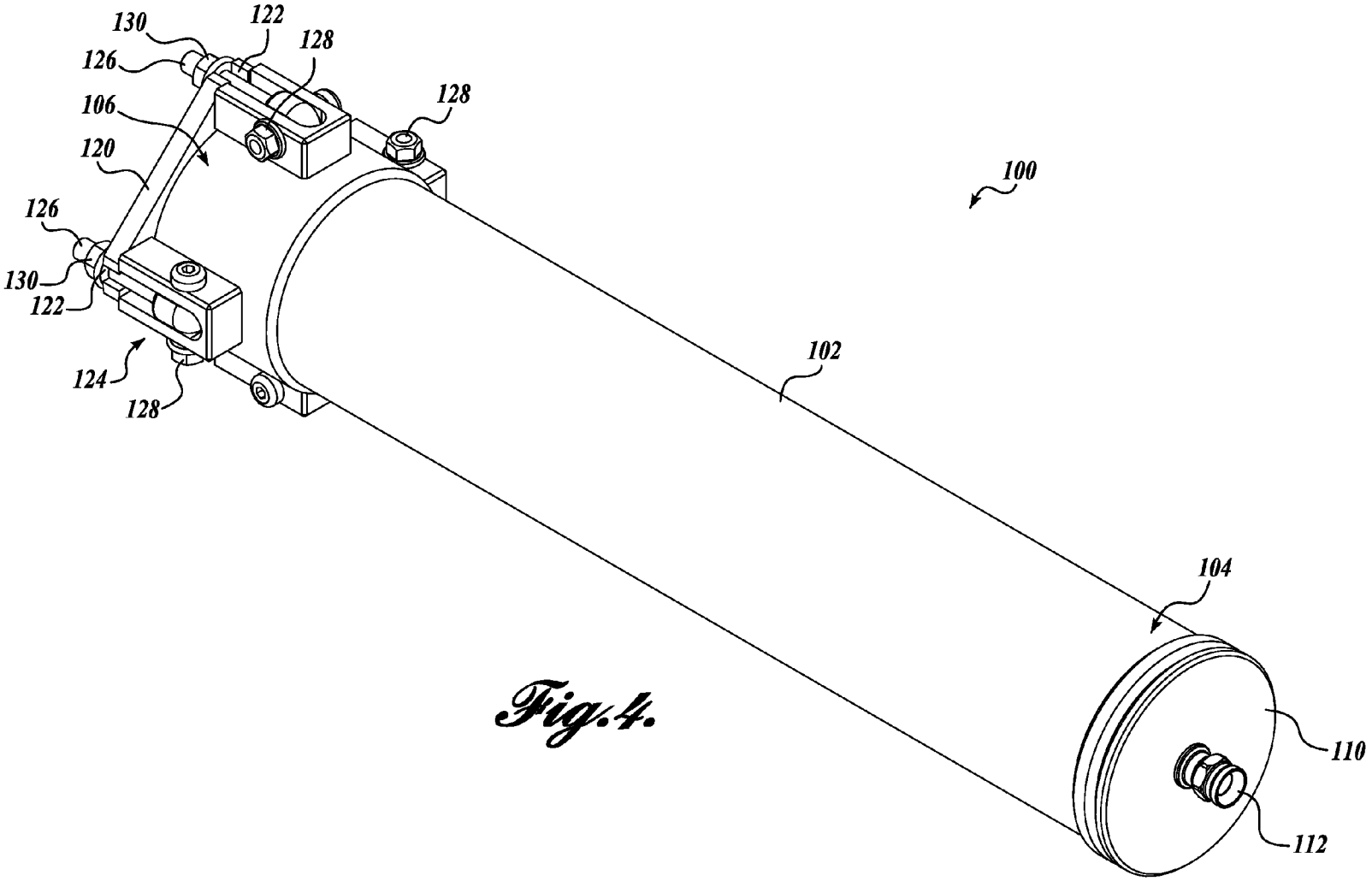
FIG. 4 shows an isometric view of a paint cartridge that is mountable to the docking station of FIG. 2.
Figure 5:
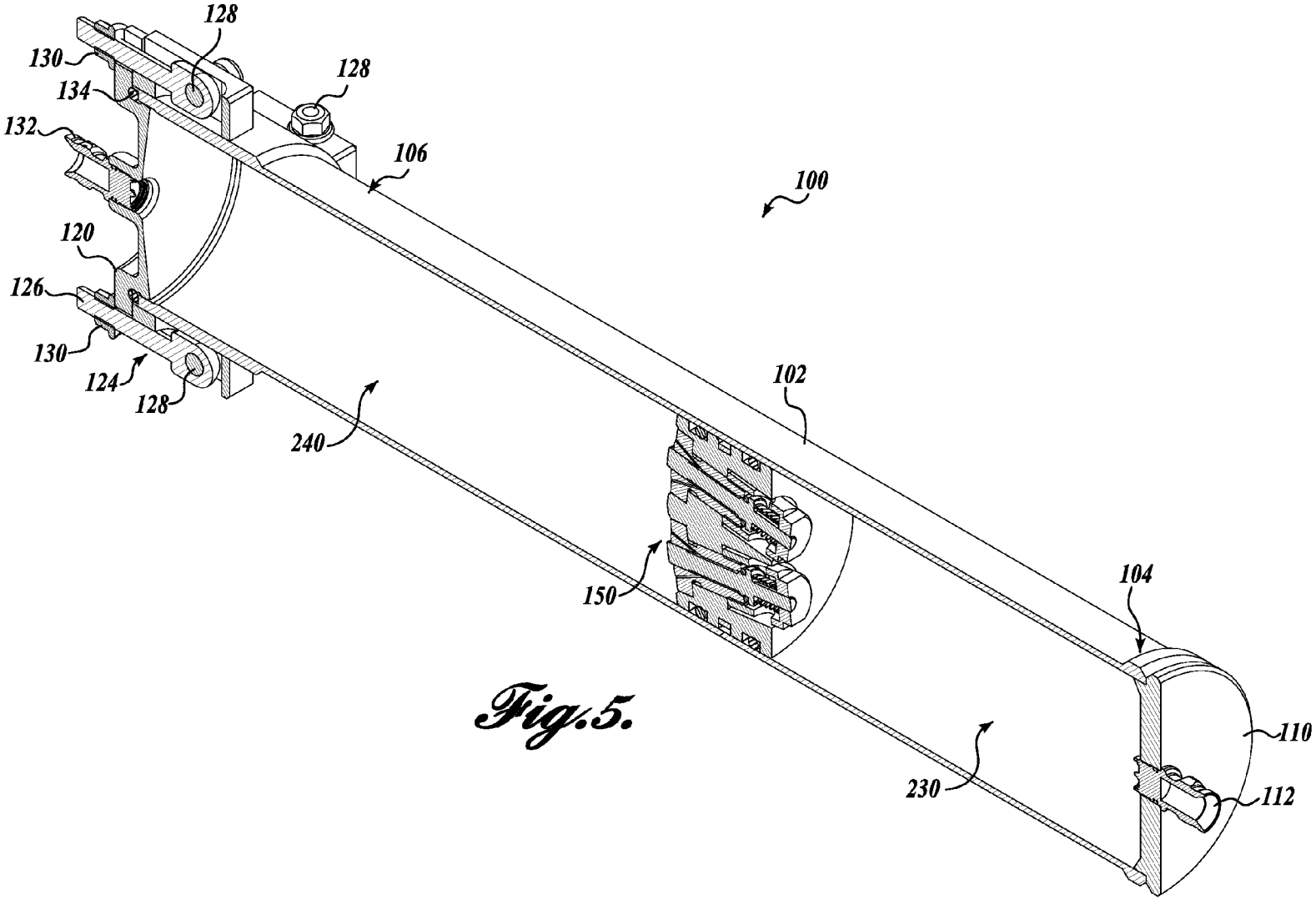
FIG. 5 shows an isometric cross-sectional view of the paint cartridge of FIG. 4.

As shown in FIGS. 4 and 5, the paint cartridge 100 includes a cylindrical housing 102 having a first end 104 and a second end 106. A first end fitting 110 is secured to the opening of the first end 104 of the housing 102 by a press-fit installation, threaded engagement, or other suitable configuration. A connector 112 sized and configured to provide a fluid connection with the supply fitting 62 of the docking station 50 is coupled to the first end fitting 110 so that when the cartridge 100 is mounted to the docking station, the supply fitting 62 is in fluid communication with an interior portion of the housing 102.

A second end fitting 120 is removably secured to a second end 106 of the housing 102 by a locking mechanism 124. A valve 132, which is preferably a drip-proof valve, is coupled to the second end fitting 120 and is sized and configured to provide a fluid connection with the discharge fitting 64 of the docking station 50 so that when the cartridge 100 is mounted to the docking station, the discharge fitting 64 is in fluid communication with an interior portion of the housing 102.

The locking mechanism 124 includes a plurality of threaded rods 126 rotatably coupled to the outer surface of the housing 102. More specifically, each threaded rod 126 rotates about a pin 128 secured to the housing 102 such that the threaded rod is rotatable between a locked position, in which the threaded rod is parallel to the centerline of the housing, and an unlocked position, in which the threaded rod extends outwardly from the housing.

To secure the second end fitting 120 to the housing 102, the second end fitting is positioned against the end of the housing, and the threaded rods 126 are rotated to the locked position. When in the locked position, each threaded rod extends through a corresponding slot 122 formed in the end fitting. A nut 130 is then threadedly coupled to each threaded rod 126 so that the second end fitting 120 is secured between the nut and the housing 102. An O-ring 134 is disposed between the second end fitting 120 and the housing 102 to ensure a fluid-tight connection therebetween.

Figure 6:
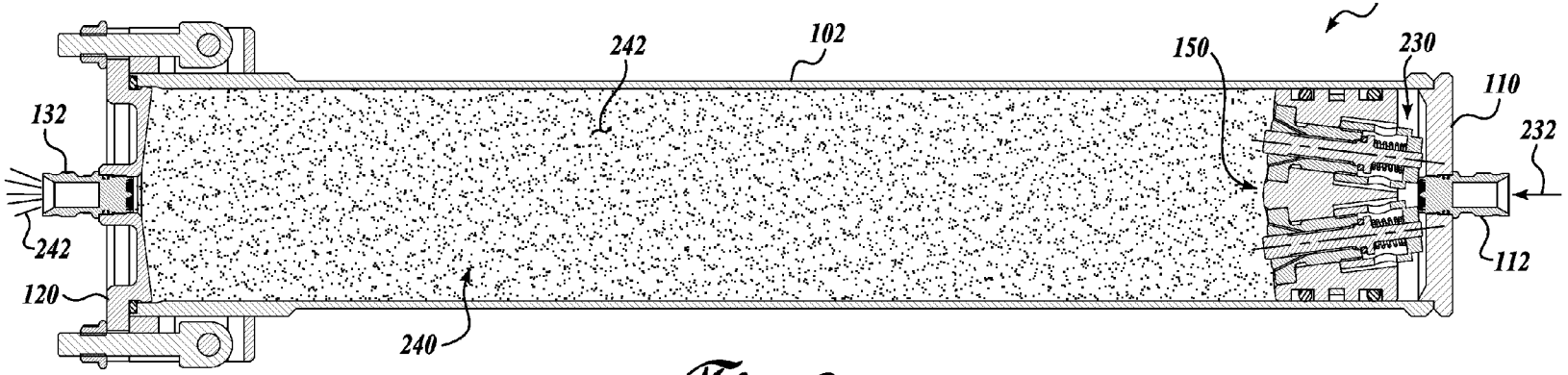
FIG. 6 shows a side cross-sectional view of the paint cartridge of FIG. 4 with the paint cartridge full of paint.
Figure 7:
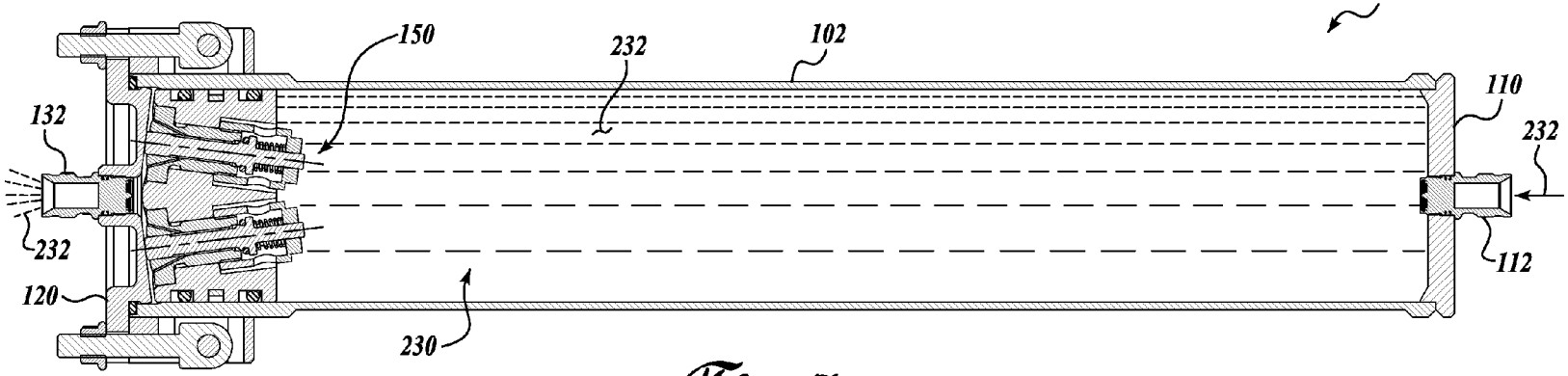
FIG. 7 shows a side cross-sectional view of the paint cartridge of FIG. 4 with the paint discharged from the cartridge.

As best shown in FIGS. 5-7, a piston assembly 150 is slidably disposed within the housing 102. The piston assembly 150 divides the interior of the cartridge 100 into a solvent chamber 230 and a paint chamber 240. As the piston assembly 150 slides within the housing 102, the volume of the solvent chamber 230 and paint chamber 240 change, such that when the volume of the solvent chamber 230 increases, the volume of the paint chamber 240 decreases by a corresponding amount. Similarly, a decrease in the volume of the solvent chamber 230 is accompanied by a corresponding increase in the volume of the paint chamber 240.

When the cartridge 100 is filled with paint, as shown in FIG. 6, the piston assembly 150 is positioned proximal to the first end fitting 110 so that the paint chamber 240 is at or near its maximum volume and is full of paint 242. To discharge the paint 242 from the cartridge 100, pressurized solvent 232 is introduced into the solvent chamber 230 through connector 112. The pressure on the solvent side of the piston assembly 150 drives the piston assembly toward the second end fitting 120, decreasing the size of the paint chamber 240 and forcing paint 242 out of valve 132. The pressurized paint is supplied to the nozzle 32, which directs the paint to a desired surface. As the volume of the paint chamber 240 decreases, the volume of the solvent chamber 230 increases and remains filled with solvent 232.

As the cartridge 100 approaches a fully discharged state, as shown in FIG. 7, a portion of the piston assembly 150 contacts the second end fitting 120 to open one or more valve assemblies 170 located in the piston assembly. With the valve assemblies 170 open, the solvent chamber 230 is in fluid communication with the paint chamber 240. The pressurized solvent 232 in the solvent chamber 230 passes through the open valve assemblies and out the discharge valve 132, cleaning the paint chamber 240 in the process.

Figure 8:
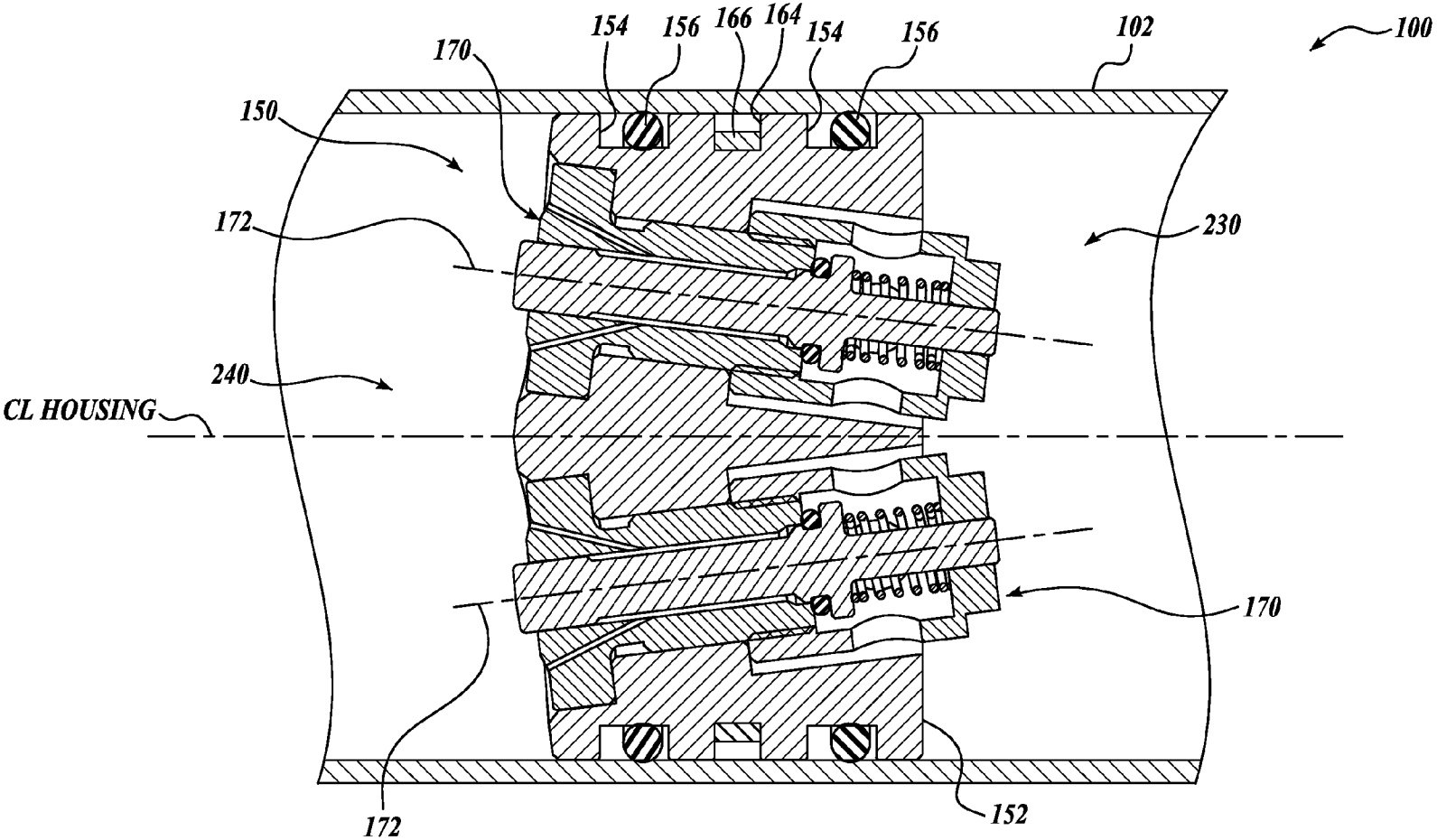
FIG. 8 shows a side cross-sectional view of a piston assembly of the paint cartridge of FIG. 4.
Figure 9:
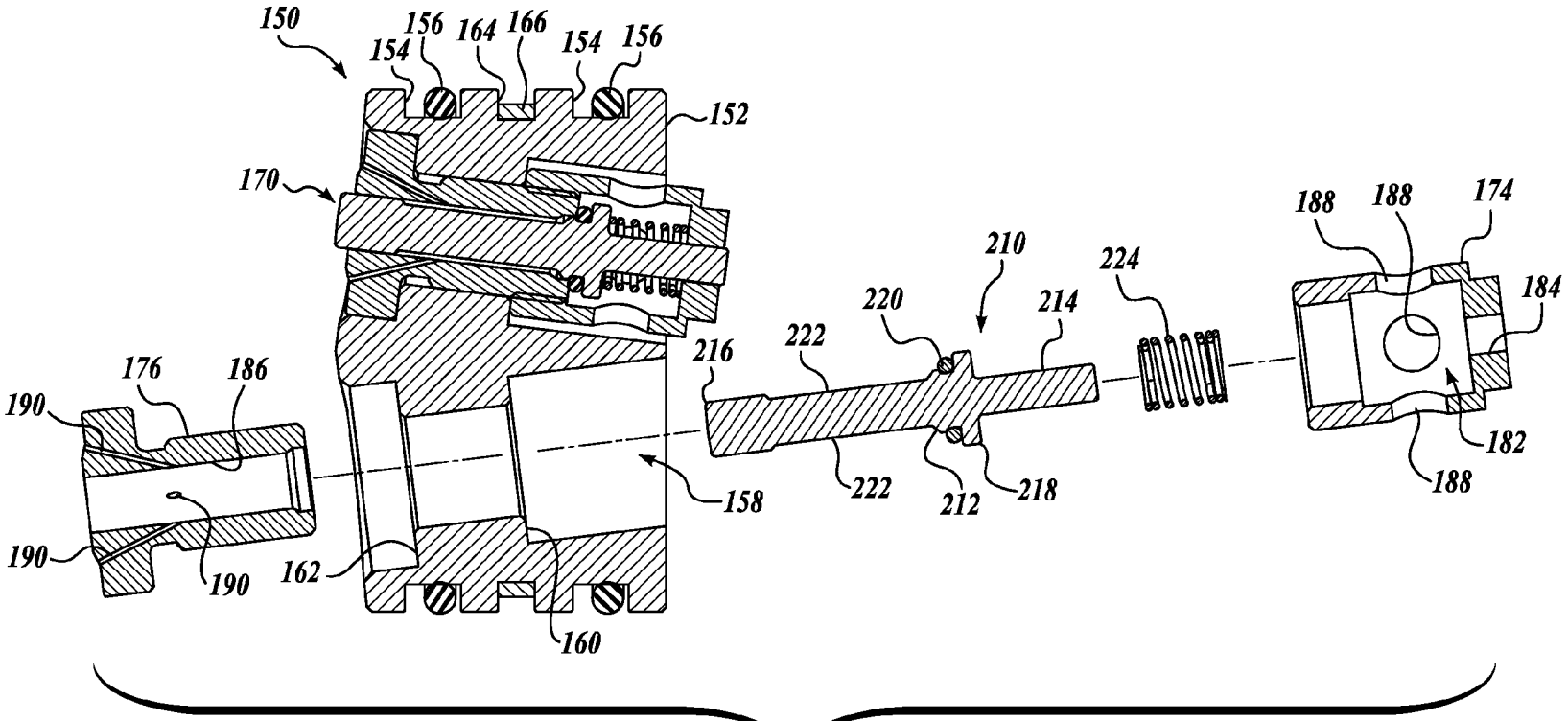
FIG. 9 shows a partially exploded side cross-sectional view of the piston assembly of FIG. 8.

Referring to FIGS. 8-9, the piston assembly 150 includes a piston 152. The outer diameter of the piston 152 is smaller than the inner diameter of the housing 102 so that the piston slides freely within the housing along the central axis of the housing. A pair of annular recesses 154 extends around the perimeter of the piston 152. A piston ring 156 is partially disposed within each recess 154. The piston rings 156 are illustrated as O-rings, however, it will be appreciated that any suitable piston ring configuration, such as a piston ring from an internal combustion engine, can be utilized. The piston rings 156 provide a generally fluid-tight seal between the outer surface of the piston 152 and the inner surface of the housing 102.

A third circumferential recess 164 extends around the perimeter of the piston 152 between the piston rings 156. A plurality of magnets 166 are positioned within the recess 164. The magnets 166 are sized and configured to be fully disposed within the recess 164 and are detectable by the position sensor 68.

Referring to FIG. 8, the piston assembly 150 includes one or more valve assemblies 170 extending through the piston 152. The valve assemblies 170 are preferably positioned such that the centerline 172 of each valve assembly forms an angle with the centerline 108 of the housing 102. More specifically, each valve assembly 170 is further away from the centerline 108 of the housing 102 on the paint chamber 240 side of the piston assembly 150 than on the solvent chamber 230 side of the piston assembly. It will be appreciated that the illustrated angles are exemplary only and should not be considered limiting. In this regard, the orientation of the valve assemblies 170 can vary. Further, the type and number of valve assemblies 170 of a particular embodiment can vary. These and other valve assembly configurations are contemplated and should be considered within the scope of the present disclosure.

As shown in FIG. 9, each valve assembly 170 includes a first retainer fitting 174 threadedly coupled to a second retainer fitting 176. The first and second retainer fittings 174 and 176 extend into a passage 158 formed in the piston 152 from opposite sides of the passage. The passage 158 has a smaller diameter in the central portion than at the ends so that shoulders 160 and 162 are formed within the passage. When the first and second retainer fittings 174 and 176 are coupled to each other, they exert a clamping force on the shoulders 160 and 162 that secures the retainer fittings within the passage 158 and, therefore, to the piston 152.

When coupled together and mounted to the piston 152, the first and second retainer fittings 174 and 176 cooperate to form a valve retainer 180 that maintains a valve 210 in sliding relation to the piston 152. Still referring to FIG. 9, the valve 210 has an elongate body 212 with a first end 214 and a second end 216. A flange 218 extends radially outward from the elongate body 212 between the first and second ends 214 and 216 of the body. An O-ring 220 is mounted to the body next to the side of the flange 218 closest to the second end 216 of the body. The valve 210 further includes a plurality of grooves 222 extending longitudinally along the second end 216 of the body.

When the valve assembly 170 is mounted to the piston 152, the valve 210 is slidably retained within the valve retainer 180. The flange 218 and the O-ring 220 are positioned within a cavity 182 in the valve retainer 180. The cavity 182 is positioned between a first passage 184 formed in the first retainer fitting 174 and a second passage 186 formed in the second retainer fitting 176. The first end 214 of the valve 210 is slidingly restrained by the first passage 184, and the second end 216 of the valve is slidingly restrained by the second passage 186 so that the valve is slidable along the centerline 172 of the valve assembly 170.

A plurality of apertures 188 are formed in the first retainer fitting 175 so that the cavity 182 of the valve retainer 180 is in fluid communication with the solvent chamber 230. When the valve 210 is in an open position (described later), the cavity 182 and thus, the solvent chamber 230, are in fluid communication with the grooves 222 in the valve. The grooves 222 in the valve 210 are themselves in fluid communication with the paint chamber 240 by way of a plurality of apertures 190 formed in the second retainer fitting 176.

As shown in FIGS. 8 and 9, the valve 210 is positioned within the valve retainer 180 so that the flange 218 is disposed within the cavity 182 of the valve assembly 170 so that the O-ring 220 is located between the flange 218 of the valve and the second retainer fitting 176. A spring 224 is positioned within the cavity 182 to bias the flange 218 toward the second retainer fitting 176. Under typical operating conditions, the spring 224 biases the valve 210 so that the O-ring 220 maintains contact with the second retainer fitting 176 to block fluid communication between the cavity 182 and the grooves 222 in the valve, i.e., to seal the cavity from the grooves 222. In this manner, separation between the solvent chamber 230 and the paint chamber 240 is maintained.

Figure 10:
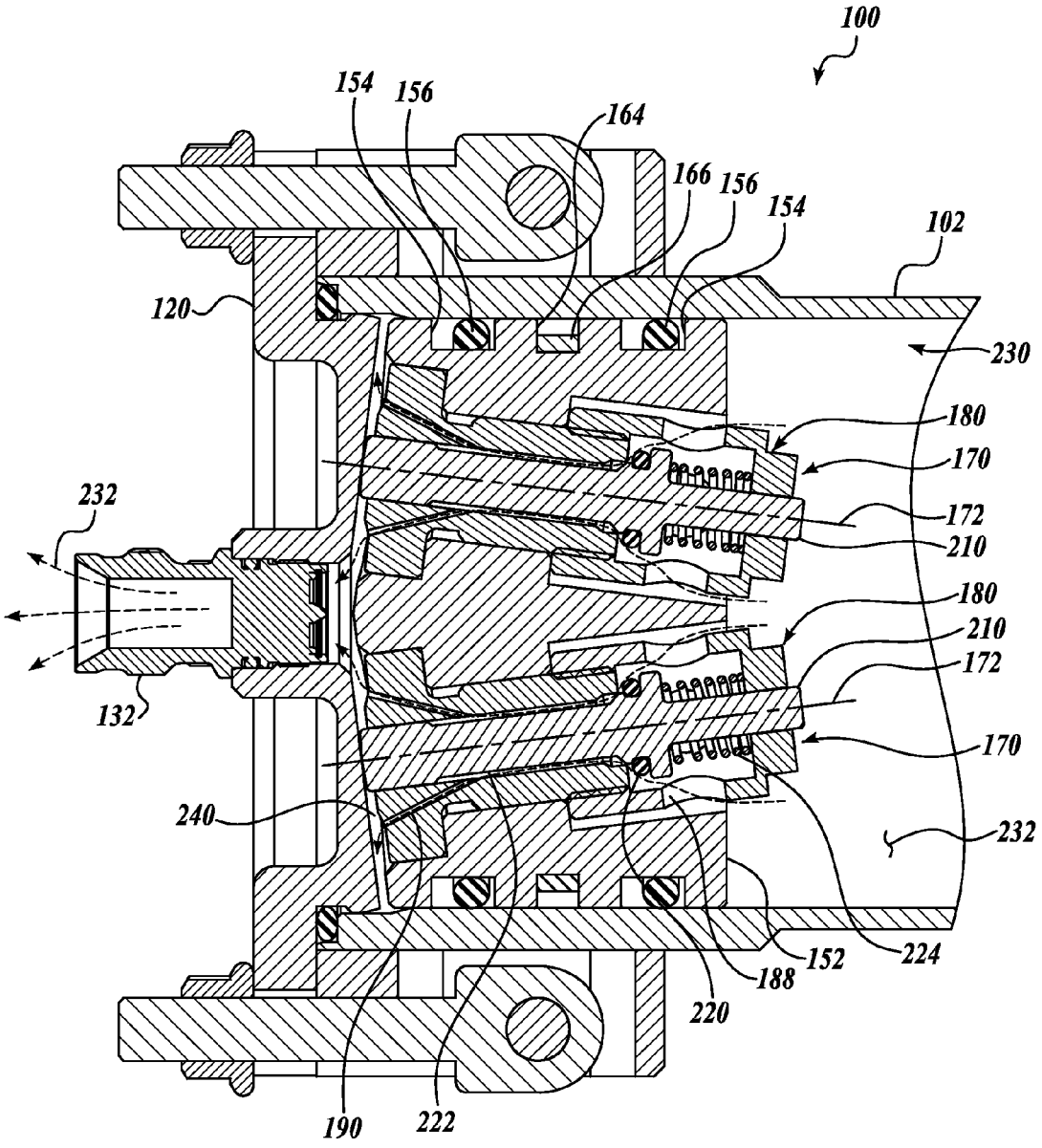
FIG. 10 shows a partial side cross-sectional view of the paint cartridge of FIG. 4 with the piston assembly engaging an end fitting of the paint cartridge.

Referring now to FIG. 10, as the piston assembly 150 approaches the second end fitting 120, the valves 210 contact an interior surface of the second end fitting. As the piston assembly 150 continues to move toward the second end fitting 120, the second end fitting drives the valves 210 from the closed position shown in FIG. 8 to the open position shown in FIG. 10. With the valves 210 open, the solvent chamber 230 is in fluid communication with the paint chamber 240. The higher pressure on the solvent side of the piston assembly 150 forces the solvent through the valve assemblies 170 into the paint chamber 240, so that the solvent cleans residual paint out of the paint chamber before being discharged through the discharge valve 132. In this manner, the paint chamber 240 and the discharge valve 132 are flushed of any residual paint.

When the cartridge 100 is "empty," i.e., has no paint in it, the piston assembly 150 is positioned next to the second end fitting 120, and the solvent chamber 230 and paint chamber 240 are both filled with solvent. In one exemplary method of filling the cartridge 100 with paint, the locking mechanism 124 is disengaged, and the second end fitting 120 is removed from the cartridge. A pneumatic press is utilized to move the piston assembly 150 to a desired position within the housing 102, wherein the position of the piston assembly corresponds to a desired amount of paint to be loaded into the cartridge 100. The housing is then filled with paint, and the second end fitting 120 is mounted to the cartridge 100 and secured in place with the locking mechanism 124.

Referring back to FIGS. 1 and 2, one contemplated embodiment of a paint system utilizes multiple cartridges 100 in a single robot 20, wherein each cartridge contains a different paint. When paint of a particular color is needed, the cartridge 100 containing that color is mounted to the docking station 50, and the robot 20 applies that color paint to the work piece. When a different paint is needed, the first cartridge 100 is removed from the docking station 50 and placed in a storage area, such as supply rack. A second cartridge having the needed color is then removed from the supply rack and mounted to the docking station 50. Because solvent is used to pressurize the cartridge, only the lines between the cartridge and the nozzle need to be cleaned prior to utilizing a cartridge having a different color paint. In one contemplated embodiment, the supply rack is a rotating rack that positions a cartridge slot for removal or return of a paint cartridge.

The previously described sensor 68 tracks the position of the piston assembly 150 by sensing the position of one or more of the magnets 166 positioned in the groove 164 of the piston 152. The position of the piston assembly 150 is sent to a cpu and/or controller (not shown) that utilizes the information for various functions. For example, by determining the piston assembly 150 position, it can be verified that the paint cartridge is fully flushed of all paint before removal from the docking station 50. The position of the piston assembly 150 can also be utilized to determine if the amount of paint in a canister 100 is sufficient to complete an upcoming paint job. In another contemplated embodiment, a sensor is included in the paint filling station and is used to help position the piston assembly and, therefore, paint capacity based on the requirements of an upcoming paint job. These and other embodiments for using the position of the piston assembly for various tasks are contemplated and should be considered within the scope of the present disclosure.

In the illustrated embodiment, the magnets 166 are neodymium magnets, and the sensor 68 is a linear magnetorestrictive transducer. The sensor 68 sense the position of the magnets through the housing 102 of the paint cartridge 100, which in the illustrated embodiment is made of stainless steel. It will be appreciated that the present disclosure is not limited to the neodymium magnets and a magneto restrictive transducer, but can include any suitable sensor system suitable of sensing the position of the piston assembly 150 within the cartridge 100. It will be further appreciated that different sensor systems may be more suitable than others depending upon the material from which the housing 102 is made.

It will be appreciated that the disclosed paint cartridge 100 is suitable for use in a number of applications, and the exemplary embodiments disclosed herein should not be considered limiting. In this regard, the disclosed paint cartridge can be used in conjunction with manual paint applicators or in systems applying a single paint color. These and other applications that could utilize a replaceable paint cartridge are contemplated and should be considered within the scope of the present disclosure.

While illustrative embodiments have been illustrated and described, it will be appreciated that various changes can be made therein without departing from the spirit and scope of the invention.

The embodiments of the invention in which an exclusive property or privilege is claimed are defined as follows:

1. A paint cartridge, comprising:

(a) a housing having an internal cavity;

(b) a piston slidably disposed within the internal cavity and moveable along a centerline of the chamber, the piston dividing the internal cavity into a paint chamber and a solvent chamber;

(c) a valve assembly extending through an aperture in the piston and including a fluid channel in fluid connection with the solvent chamber and the paint chamber, the fluid channel being positioned at an angle relative to the centerline of the chamber, the valve assembly selectively allowing the paint chamber to be in fluid communication with the solvent chamber wherein the valve assembly comprises a valve slidably extending through the piston;

(d) a solvent inlet in fluid communication with the solvent chamber, the solvent inlet providing solvent to the solvent chamber; and (e) a paint outlet, wherein solvent is selectively provided to the solvent chamber through the solvent inlet to move the piston, movement of the piston discharging paint from the paint chamber through the paint outlet, wherein the valve assembly selectively provides a path for solvent to pass through the paint chamber and out the paint outlet, at least a portion of the path extending along and being partially defined by the valve.

2. The paint cartridge of claim 1, wherein the valve assembly is selectively moveable between an open position and a closed position, wherein the paint chamber is in fluid communication with the solvent chamber when the valve assembly is in the open position.

3. The paint cartridge of claim 2, wherein the paint chamber is sealed from the solvent chamber when the valve assembly is in the closed position.

4. The paint cartridge of claim 1, wherein the valve is reciprocal between an open position, in which fluid passes from the solvent chamber to the paint chamber, and a closed position.

5. The paint cartridge of claim 4, wherein the valve blocks the fluid path when the valve is in the closed position.

6. The paint cartridge of claim 4, the valve assembly further comprising a spring biasing the valve toward the closed position.

7. The paint cartridge of claim 4, wherein the valve contacts an inner surface of the housing to move the valve from the closed position to the open position.

8. The paint cartridge of claim 1, further comprising a sensor sensing a position of the piston within the housing.

9. The paint cartridge of claim 8, further comprising at least one magnet coupled to the piston, wherein the sensor senses the position of the magnet.

10. The paint cartridge of claim 9, wherein the sensor is a linear magnetostrictive transducer.

11. A paint cartridge, comprising:

(a) a housing having an internal cavity;

(b) a piston slidably disposed within the internal cavity and moveable along a centerline of the chamber, the piston dividing the internal cavity into a paint chamber and a solvent chamber;

(c) a valve assembly selectively opening and closing fluid communication between the paint chamber and the solvent chamber, the valve assembly including a fluid channel in fluid connection with the solvent chamber and the paint chamber, the fluid channel being positioned at an angle relative to the centerline of the chamber;

(d) a solvent supply in fluid communication with the solvent chamber; and (e) a paint outlet, wherein the solvent supply provides pressurized solvent to the solvent chamber to move the piston.

12. The paint cartridge of claim 11, the valve assembly further including a valve slidably coupled to the piston, the valve selectively blocking the fluid channel.

13. The paint cartridge of claim 12, wherein the valve assembly is moveable between a closed position, in which the valve blocks the fluid channel, and an open position, in which the valve allows fluid to pass through the fluid channel.

14. The paint cartridge of claim 13, wherein the pressurized solvent biases the piston to discharge paint through the paint outlet when the valve is in the closed position.

15. The paint cartridge of claim 12, wherein movement of the piston moves the valve into contact with an inner surface of the housing.

16. The paint cartridge of claim 15, wherein contact between the valve and the inner surface of the housing moves the valve from the closed position to the open position.

17. The paint cartridge of claim 16, wherein pressurized solvent passes through the fluid channel when the valve is in the open position.

* * * * *